United States Patent [19]

McGlaughlin

[11] 3,969,699

[45] July 13, 1976

[54] IMAGE DISSECTOR WITH MANY APERTURES FOR HADAMARD ENCODING

[75] Inventor: Laurence D. McGlaughlin, Edina, Minn.

[73] Assignee: Honeywell Inc., Minneapolis, Minn.

[22] Filed: Apr. 11, 9175

[21] Appl. No.: 567,154

[52] U.S. Cl. ..... 340/146.3 F; 235/164; 250/207; 315/11; 313/103 R; 340/146.3 MA

[51] Int. Cl.[2] ..... H01J 39/12

[58] Field of Search..... 315/10, 11, 365; 250/207; 313/65 R, 103 R; 340/146.3 F, 146.3 G, 146.3 MA, 146.3 SY; 235/164, 197

[56] References Cited

UNITED STATES PATENTS

| | | | |
|---|---|---|---|
| 3,366,735 | 1/1968 | Hecker | 340/146.3 F |
| 3,694,806 | 9/1972 | Freedman | 340/146.3 F |
| 3,720,838 | 3/1973 | Catchpole | 250/207 R |
| 3,803,443 | 4/1974 | Hant | 315/11 |
| 3,815,090 | 6/1974 | Muenchhausen | 340/146.3 MA |
| 3,859,515 | 1/1975 | Radcliffe | 340/146.3 SY |

OTHER PUBLICATIONS

Decker, "Hadamard–Transform Image Scanning," *Applied Optics*, vol. 9, No. 6, June, 1970. pp. 1392–1395.

ETT, "Character Recognition Image Dissector," *IBM Tech. Disclosure Bulletin*, vol. 12, No. 9, Feb. 1970. pp. 1339–1340.

*Primary Examiner*—Leo H. Boudreau

*Attorney, Agent, or Firm*—Omund R. Dahle

[57] ABSTRACT

An improved image dissector camera tube system for improving the signal-to-noise ratio in which the aperture plate of the image dissector has a plurality of apertures, the apertures individually biased by an electronic control network to accomplish a Hadamard encoding of the electron image.

3 Claims, 19 Drawing Figures

| | | | | | | |
|---|---|---|---|---|---|---|
| + | + | + | − | + | − | − |
| + | + | + | − | + | − | − |
| + | + | + | − | + | − | − |
| − | − | − | − | − | − | − |
| + | + | + | − | + | − | − |
| − | − | − | − | − | − | − |
| − | − | − | − | − | − | − |

APERTURE VOLTAGES
1st SCAN

| | | | | | | |
|---|---|---|---|---|---|---|
| 20 | 40 | 0 | 20 | 40 | 20 | 20 |
| 24 | 44 | 6 | 24 | 42 | 22 | 22 |
| 24 | 44 | 6 | 24 | 42 | 22 | 22 |
| 24 | 44 | 6 | 24 | 42 | 22 | 22 |
| 20 | 40 | 0 | 20 | 40 | 20 | 20 |
| 20 | 40 | 0 | 20 | 40 | 20 | 20 |
| 24 | 44 | 6 | 24 | 42 | 22 | 22 |

HADAMARD IMAGE

| | 1 | 2 | 3 | 4 | 5 | 6 | 7 |
|---|---|---|---|---|---|---|---|
| 1 | | 5 | | | | 5 | |
| 2 | | 5 | | | | 5 | |
| 3 | | 5 | | | | 5 | |
| 4 | | 5 | 2 | 2 | 2 | 5 | |
| 5 | | 5 | | | | 5 | |
| 6 | | 5 | | | | 5 | |
| 7 | | 5 | | | | 5 | |
FIG. 6
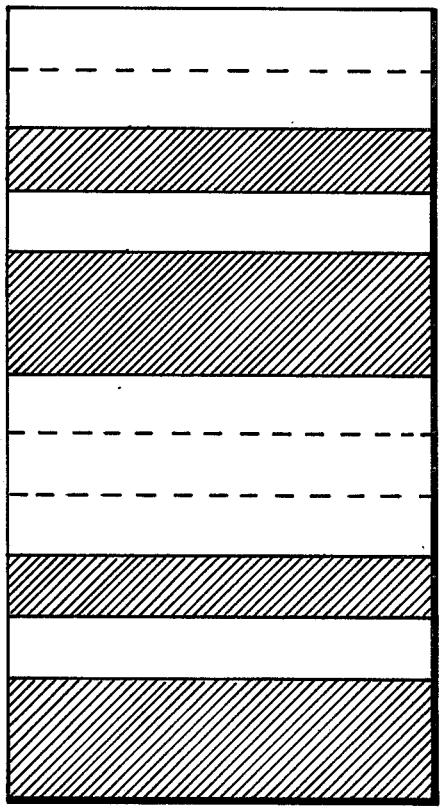
FIG. 10
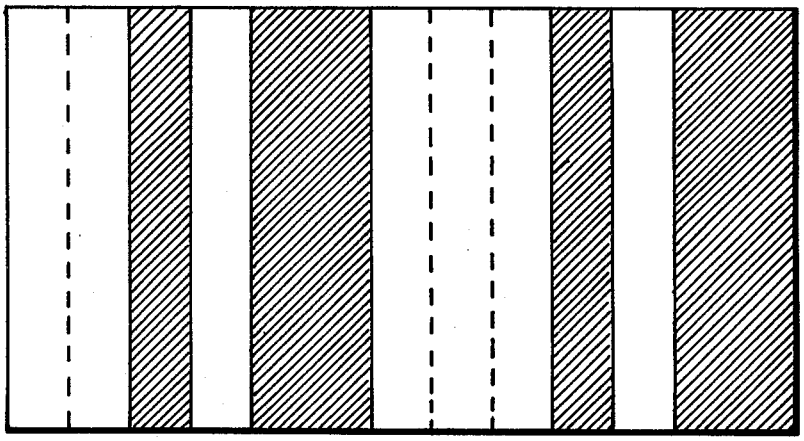
FIG. 9

| | 1 | 2 | 3 | 4 | 5 | 6 | 7 |
|---|---|---|---|---|---|---|---|
| 1 | | 5 | | | | | |
| 2 | | 5 | | | | | |
| 3 | | 5 | | | | | |
| 4 | | | | | | | |
| 5 | | 5 | | | | | |
| 6 | | | | | | | |
| 7 | | | | | | | |

FIG. 11

| | 1 | 2 | 3 | 4 | 5 | 6 | 7 |
|---|---|---|---|---|---|---|---|
| 1 | | | | | | | |
| 2 | | | | | | | |
| 3 | | | | | | | |
| 4 | | | 2 | 2 | 2 | | |
| 5 | | | | | | | |
| 6 | | | | | | | |
| 7 | | | | | | | |

FIG. 12

| | 1 | 2 | 3 | 4 | 5 | 6 | 7 |
|---|---|---|---|---|---|---|---|
| 1 | | 5 | | | | 5 | |
| 2 | | 5 | | | | 5 | |
| 3 | | | | | | | |
| 4 | | 5 | | | 2 | 5 | |
| 5 | | | | | | | |
| 6 | | | | | | | |
| 7 | | 5 | | | | 5 | |

FIG. 13

S =

| | | | | | | |
|---|---|---|---|---|---|---|
| 1 | 1 | 1 | 0 | 1 | 0 | 0 |
| 0 | 1 | 1 | 1 | 0 | 1 | 0 |
| 0 | 0 | 1 | 1 | 1 | 0 | 1 |
| 1 | 0 | 0 | 1 | 1 | 1 | 0 |
| 0 | 1 | 0 | 0 | 1 | 1 | 1 |
| 1 | 0 | 1 | 0 | 0 | 1 | 1 |
| 1 | 1 | 0 | 1 | 0 | 0 | 1 |

FIG. 14

$S^{-1} =$

| | | | | | | |
|---|---|---|---|---|---|---|
| 1 | −1 | −1 | 1 | −1 | 1 | 1 |
| 1 | 1 | −1 | −1 | 1 | −1 | 1 |
| 1 | 1 | 1 | −1 | −1 | 1 | −1 |
| −1 | 1 | 1 | 1 | −1 | −1 | 1 |
| 1 | −1 | 1 | 1 | 1 | −1 | −1 |
| −1 | 1 | −1 | 1 | 1 | 1 | −1 |
| −1 | −1 | 1 | −1 | 1 | 1 | 1 |

FIG. 15

$(S^{-1})^T =$

| | | | | | | |
|---|---|---|---|---|---|---|
| 1 | 1 | 1 | −1 | 1 | −1 | −1 |
| −1 | 1 | 1 | 1 | −1 | 1 | −1 |
| −1 | −1 | 1 | 1 | 1 | −1 | 1 |
| 1 | −1 | −1 | 1 | 1 | 1 | −1 |
| −1 | 1 | −1 | −1 | 1 | 1 | 1 |
| 1 | −1 | 1 | −1 | −1 | 1 | 1 |
| 1 | 1 | −1 | 1 | −1 | −1 | 1 |

FIG. 16

$S^{-1}$ (FIG.15) X HADAMARD IMAGE (FIG. 8) =

INTER. SOL.

| | | | | | | |
|---|---|---|---|---|---|---|
| 20 | 40 | 0 | 20 | 40 | 20 | 20 |
| 20 | 40 | 0 | 20 | 40 | 20 | 20 |
| 20 | 40 | 0 | 20 | 40 | 20 | 20 |
| 36 | 56 | 24 | 36 | 48 | 28 | 28 |
| 20 | 40 | 0 | 20 | 40 | 20 | 20 |
| 20 | 40 | 0 | 20 | 40 | 20 | 20 |
| 20 | 40 | 0 | 20 | 40 | 20 | 20 |

FIG. 17a

INTERMEDIATE SOLUTION (FIG. 17a) X $(S^{-1})^T$ (FIG.16) =

$\left(\frac{N+1}{2}\right)^2$ (INPUT)

| | | | | | | |
|---|---|---|---|---|---|---|
| 0 | 80 | 0 | 0 | 0 | 80 | 0 |
| 0 | 80 | 0 | 0 | 0 | 80 | 0 |
| 0 | 80 | 0 | 0 | 0 | 80 | 0 |
| 0 | 80 | 32 | 32 | 32 | 80 | 0 |
| 0 | 80 | 0 | 0 | 0 | 80 | 0 |
| 0 | 80 | 0 | 0 | 0 | 80 | 0 |
| 0 | 80 | 0 | 0 | 0 | 80 | 0 |

FIG. 17b

IMAGE DISSECTOR WITH MANY APERTURES FOR HADAMARD ENCODING

BACKGROUND OF THE INVENTION

Image dissector type television camera tubes are a well-known, non-storage type of camera tube that utilizes a photoemissive light-sensitive surface. The tube has been described as one which does not have a scanning beam but which collects and directly amplifies the electron image emitted from the photosensitive surface. The image being viewed by the camera is focused on a transparent photoemissive surface on the inside of the camera tube. Electrons are emitted from all areas on the photosurface in densities which are a function of the brightness of the image at that location. The electron image is conveyed as a whole to the opposite end of the tube where it encounters an electrode or plate having a small aperture. Under the control of external magnetic deflection coils or electric deflection plates, the electron image is deflected past this aperture so that the image is explored by the aperture in a series of horizontal adjacent lines. As a result, the aperture periodically samples the entire photoelectric image. The electrons which enter the aperture constitute the current impulses corresponding to the successive values of brightness passing by the aperture. The electrons entering the aperture are multiplied by secondary emissions of the multiplier dynodes. The electrons that do not pass through the aperture are not utilized. Since no charge storage occurs in the image dissector, its sensitivity is low. Conventional image dissector tubes receive electrons through only one aperture, that is, from only one element of the scene at a time. The use of multiple apertures has been considered in the prior art. Several such examples are U.S. Pat. Nos. 3,274,581, 3,333,145 and 3,720,838.

SUMMARY OF THE INVENTION

In this invention a plurality of apertures are used in an image dissector tube. This multiple aperture plate together with electronic programmed modulator apparatus means such as a prewired switching sequence generator for selectively controlling and switching the multiple apertures, establishes an electronic pattern which will accomplish encoding of the image, thus permitting the image dissector tube to integrate over a longer dwell time for each image element while maintaining the same frame time thus providing a higher signal-to-noise ratio. Further electronic apparatus for solving the coding provides a greatly improved image.

BRIEF DESCRIPTION OF THE DRAWINGS

FIG. 6 is a representation of an image in graphical/numerical form;

FIGS. 9 and 10 are optical mask analogies of Hadamard transform encoders;

FIGS. 11, 12, and 13 show the coding at various scan positions;

FIG. 14 describes the transform S;

FIG. 15 describes the inverse of the transform $S^{-1}$;

FIG. 16 shows the transpose of the inverse of the transform $(S^{-1})^T$; and FIGS. 17*a* and 17*b* are an example of the solution of the transform by the apparatus of FIG. 5.

DESCRIPTION

Figure 1:
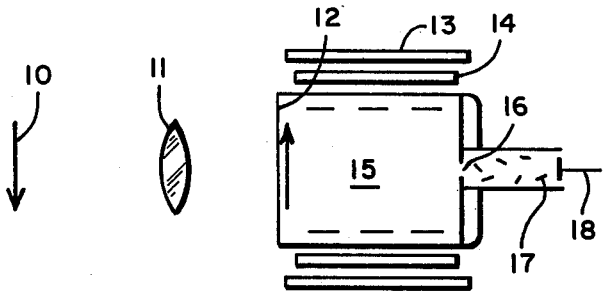
FIG. 1 discloses a conventional image dissector television camera tube such as is known in the prior art.

FIG. 1 discloses in simplified form a conventional image dissector television camera tube, such as is well-known in the art, the image dissector employing a photosensitive cathode 12 which does not store a charge but which liberates an electron image when illuminated by the optical image 10 focused on it. The electron image 15 so produced is conveyed as a whole to the opposite end of the tube. The electron image is deflected past an aperture 16 so that the entire image is explored by the aperture in a series of sweep lines. The electrons which enter the aperture constitute the current impulses corresponding to the successive values of brightness passing by the aperture. The electron current entering the aperture is multiplied by the multiplier dynodes 17 before providing a signal output 18.

Figure 2:
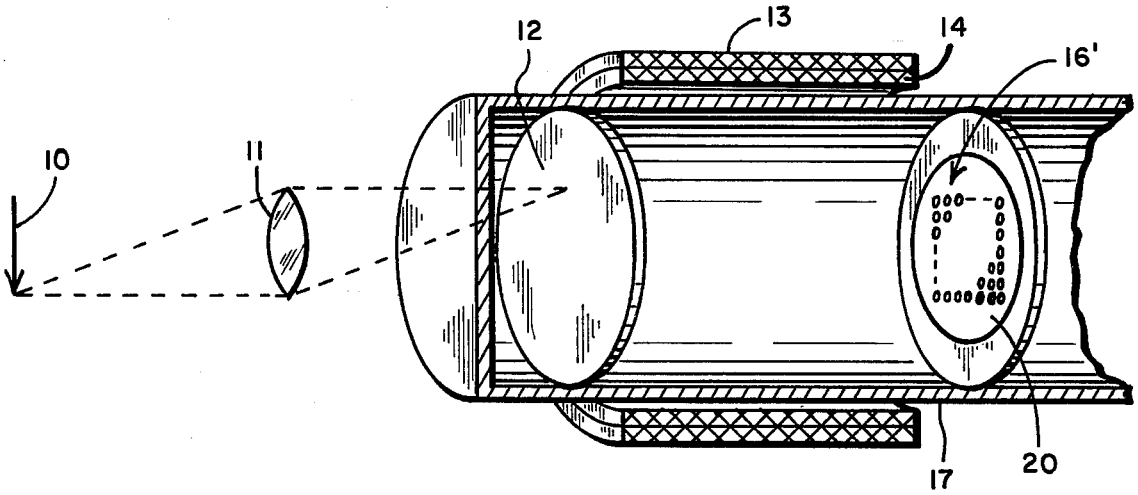
FIG. 2 shows an image dissector tube having a plurality of apertures in the aperture plate.

In the present invention the image dissector camera tube as shown in FIG. 2 is modified to provide a large number of apertures 16′ in the aperture plate rather than one aperture as is common. Many elemental bits of the electron image are thus seen at one time by the apertures. The many apertures are biased selectively so as to feed the electron picture through the many apertures in different parallel combinations to accomplish Hadamard encoding of the scene. This permits the image dissector tube to integrate over a longer dwell time for each image element while maintaining the same frame time thus providing a higher signal-to-noise ratio. The average improves with the square root of the viewing time.

Figure 3:
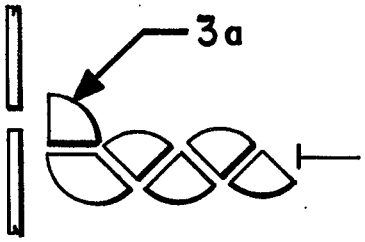
FIG. 3 is a representation of the multiplier dynodes which are positioned behind the aperture in an image dissector tube and FIG. *3a* is a perspective view of one of the dynodes.
Figure 3A:
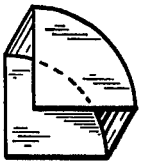

For illustrative purposes, the multiple aperture arrangement has been shown as a 7 × 7 array of 49 apertures, 16′. There is no significance in the choice of a 7 × 7 array other than convenience of explanation, and any suitable size array may be used. Behind the aperture array 16′ is a conventional dynode multiplier such as is shown in FIG. 3 in which the electrons flowing through the multiple apertures are summed in a common dynode multiplier.

Figure 4:
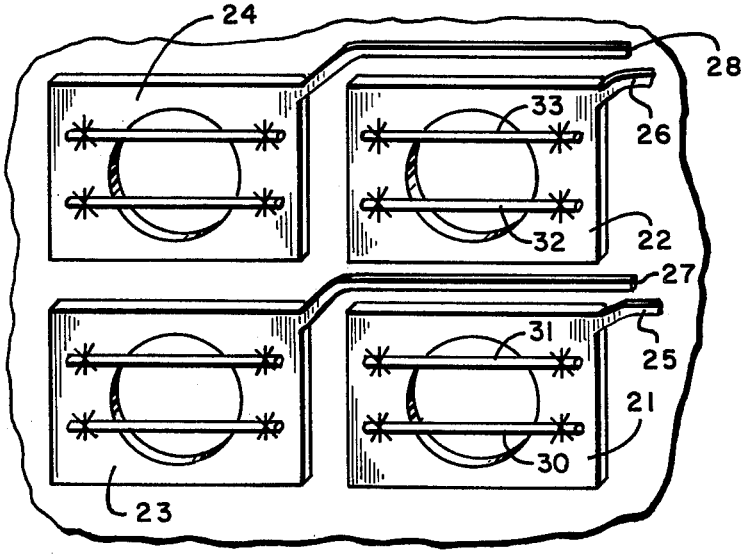
FIG. 4 is an enlargement of a portion of the aperture plate area.

FIG. 4, an enlargement of a portion of the multiple aperture plate, shows an embodiment of how the individual apertures are selectively biased. A non-conductive substrate 20 having the grid of 49 apertures therein, has an evaporated film of aluminum, or other metal, surrounding each aperture, the metalized areas being identified as 21, 22, 23, and 24 and having separate metalized leads 25 through 28 to which external connection is made. The individual apertures have a diameter of about 3 to 4 mils, and spot welded to the metalized areas across the apertures are control wires such as shown at 30, 31, 32, and 33. Each aperture with its metalization and control wire is insulated from the other 48 apertures.

Figures 5, 7, 8:
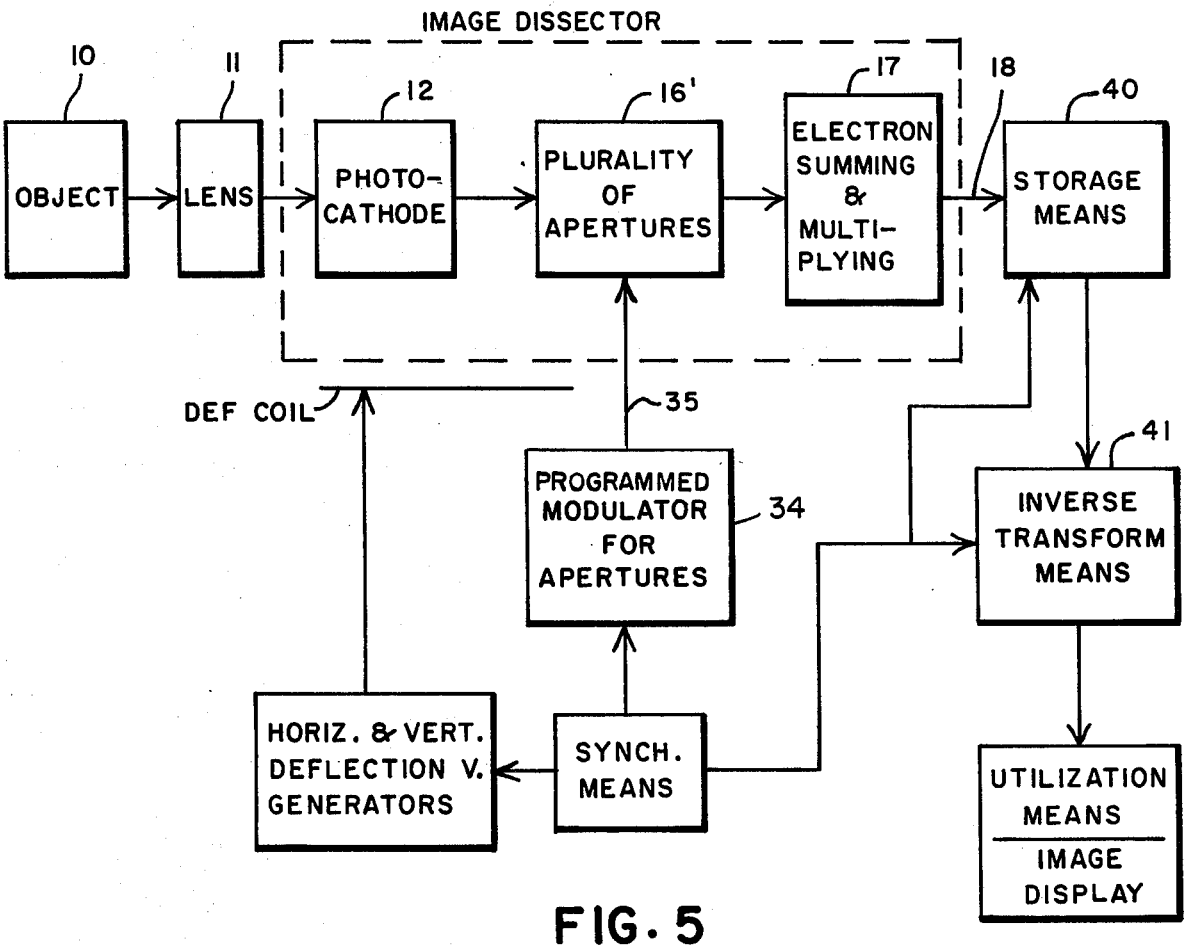
FIG. 5 is a system block diagram of the improved image dissector tube and the associated control apparatus.
FIG. 7 is a representation of one set of aperture voltages used to provide a Hadamard image.
FIG. 8 is a graphical/numerical representation of a Hadamard image produced from the image of FIG. 6.

In the system block diagram of FIG. 5, a programmed modulator 34 has electrical connection 35 to the plurality of apertures 16'. The programmed modulator is preferable in the form of a prewired switching sequence generator and switches the aperture grid in the same way one addresses *n* different memory locations in a random access memory. The electrical connection 35, shown schematically simplified, includes a separate electrical connection to each of the multiple apertures. The apertures may be thought of as controllable gates or windows and electrical potentials applied to the apertures from the programmed modulator 34 open or close each gate to electrons. Each of the 49 apertures may be considered as detector means for the electron image. The detector means are controllable electron density responsive means. There are also 49 different combinations or different patterns of aperture gating applied by the sequential application of a series of programmed bias control voltages to the apertures. In this way, the detectors are caused to view the same image *n* times while sequencing through the *n* combinations thereby to generate a Hadamard image.

Let it be assumed that a stationary image is being observed which results in an electron image as shown in FIG. 6 in the form of an H. The numerical values forming the H represent relative electron intensities. Both dimensions of the deflection, i.e. the vertical and horizontal deflection, as applied by the deflection coils 14 may be in the form of stairstep increments so that the portion of the image in the view of the 7 × 7 apertures remains in position long enough for the programmed modulator system to view (i.e. electronically scan) the image portion illustrated as H 49 times.

FIG. 7 gives an example of the aperture voltages applied by the programmed modulator during the first of the 49 electronic scans of the H. The "plus" potentials as indicated in FIG. 7, allow electrons to flow through the apertures represented by those squares and the "minus" potentials represent that at these apertures, electrons are repulsed and not admitted. When the "first scan" potentials as shown in FIG. 7 are superimposed on the electronic image as shown in FIG. 6, it can be seen that there are electrons to be admitted only at four apertures of the left hand leg of the H totalling a representative count of 20. There are no electrons in the image at the location of the other "plus" biased apertures. This count of 20 is indicated in the first position of the Hadamard image of FIG. 8, the "20" being encircled in the upper left corner of the Hadamard image. The count of 20 is stored in storage means 40. The system proceeds through each of the succeeding 48 steps. During each of the 49 electronic scans, a different combination of 16 apertures is biased "plus" to allow electrons through. The count from each of these electronic scans is stored and is indicated in FIG. 8.

At this point of the description an analogy will be made to a two dimensional Hadamard optical filter (i.e. a Hadamard transform slit mask) shown by FIGS. 9 and 10. This optical analogy of the electronic biasing of the apertures is made to aid in visualizing the invention and its operation. Both the optical filter of FIG. 9 and of FIG. 10 overlay FIG. 6, with the filter of FIG. 9 to be moved in a horizontal direction a step at a time and the filter of FIG. 10 being moved vertically one step after each horizontal sweep across the image, to provide the 49 total combinations of the Hadamard transform being illustrated. The "hatched" portion of the filters of FIGS. 9 and 10 are opaque, the remainder, light transmitting windows. The same "first scan" shown by aperture voltages in FIG. 7 is reillustrated with the optical analogy in FIG. 11. Two more optical filter examples, that of the 17th scan is indicated in FIG. 12 and that of the 47th scan is indicated in FIG. 13. It will be seen that the count of 6 from FIG. 12 is encircled in FIG. 8 and the count of 42 from FIG. 13 is also encircled in FIG. 8. The optical analogy is illustrative only, the electrical encoding of the image taught herein being far superior to the mechanical analogy in a number of aspects including increased speed of operation and no moving parts.

The 7 × 7 Hadamard transform is shown in FIG. 14; the inverse of the transform $S^{-1}$ is diagrammed in FIG. 15 and the transpose of the inverse of the transform $(S^{-1})T$ is diagrammed in FIG. 16. The electron picture which was described in FIG. 6 and as it appears in the transform of FIG. 8 is now decoded. The Hadamard image information which has been stored in suitable storage means 40 is fed to inverse transform means 41 to compute the inverse transform in accordance with the relation $S^{-1} \times$ Hadamard image $\times (S^{-1})^T = ([N + 1]/2)^2$ (Input). The inverse transform means may be a computer programmed with the inverse of the coding matrix. FIG. 17 diagrammatically shows this operation. First in a premultiplication step the inverse transform $S^{-1}$ is matrixmultiplied times the Hadamard image FIG. 17*a*. The intermediate product obtained is then post matrix-multiplied by the transpose of the inverse transform $(S^{-1})^T$ In FIG. 17 *b* to provide a decoded output which is equal to ([N+ 1]/2) (input), where N is the number of apertures along one row or column of the array. In the example discussed here, each element of the image is supplying information to the system for sixteen times as large a fraction of the viewing time. Thus, the signal-to-noise ratio is improved by a factor of $\sqrt{16}$ or 4. Use of a large number of apertures would provide a greater improvement of the signal-to-noise ratio by increasing still more the efficiency in use of the available scanning time. The gain in signal-to-noise ratio is given by $G =$ approximately $\frac{1}{2} N^{1/2}$ When the required 49 scans have been made of the increment of the total image which was represented by FIG. 6, horizontal and/or vertical deflection voltage generators advance the deflection of the image to the next portion to be considered whereupon the Hadamard coding and decoding is repreated.

The embodiments of the invention in which our exclusive property or right is claimed are defined as follows:

1. An improved image dissector camera tube system comprising:

photocathode means for generating an electron image;

a plurality of normally operative detector means at known adjacent positions of the electron image for producing signals indicative of the electron density at each of the known adjacent positions;

electron controlling means for causing one of a plurality of predetermined patterns of said plurality of detector means to be inoperative during each of a plurality of successive image sampling periods, said electron controlling means further comprising programmed modulator means connected in controlling relation to each of said detector means;

combining means for combining the signals from the operative detector means during each of the plurality of sampling periods to produce a combined signal for each of said plurality of periods, said programmed modulator means together with said combining means being so coded as to cause the electron image to be transformed to a Hadamard image; and transform means for transforming the combined signals into a series of electrical signals indicative of the electron image.

2. The system according to claim 1 wherein said transform means is an inverse Hadamard transform means.

3. An improved image dissector camera tube system comprising:

photocathode means for generating an electron image;

*n* normally operative detector means at known adjacent positions of the electron image for producing signals indicative of the electron density at each of the known adjacent positions;

where *n* is an integer;

electron controlling means for causing a different one of *n* predetermined patterns of said detector means to be inoperative during each of *n* successive image sampling periods;

combining means for combining the signals from the operative detector means during each of the *n* sampling periods to produce a combined signal for each of said periods, said electron controlling means further comprising programmed modulator means connected in controlling relation to each of said detector means, said programmed modulator means together with said combining means being so coded as to cause the electron image to be transformed to a Hadamard image; and transform means for transforming the combined signals into a series of electrical signals indicative of the electron image.

* * * * *